US007389613B2

(12) United States Patent
Sondermann

(10) Patent No.: US 7,389,613 B2
(45) Date of Patent: Jun. 24, 2008

(54) HEIGHT ADJUSTABLE EDGE PROTECTOR

(75) Inventor: Frank Sondermann, Frenkhausen (DE)

(73) Assignee: Herm Friedr. Kunne GmbH & Co., Ludenscheid (DE)

( * ) Notice: Subject to any disclaimer, the term of this patent is extended or adjusted under 35 U.S.C. 154(b) by 63 days.

(21) Appl. No.: 10/756,686

(22) Filed: Jan. 12, 2004

(65) Prior Publication Data

US 2005/0039409 A1 Feb. 24, 2005

(30) Foreign Application Priority Data

Jan. 11, 2003 (DE) ..... 203 00 424 U

(51) Int. Cl.
*E04F 11/16* (2006.01)

(52) U.S. Cl. ..... 52/179; 52/716.8

(58) Field of Classification Search ..... 52/179, 52/718.01, 718.04, 718.05, 718.03, 174, 52/716.1, 716.3, 716.4, 716.8, 717.05, 717.06, 52/718.02, 177; 108/27; 312/140.3, 140.4
See application file for complete search history.

(56) References Cited

U.S. PATENT DOCUMENTS

| | | | | |
|---|---|---|---|---|
| 4,321,294 | A * | 3/1982 | Naka | 428/61 |
| 4,455,797 | A * | 6/1984 | Naka | 52/179 |
| 4,893,449 | A * | 1/1990 | Kemper | 52/464 |
| 5,806,253 | A * | 9/1998 | Nelson | 52/179 |
| 5,810,468 | A * | 9/1998 | Shimada | 362/146 |
| 5,939,670 | A * | 8/1999 | Shteynberg et al. | 174/49 |
| 6,047,506 | A | 4/2000 | Kemper | |
| 6,141,920 | A | 11/2000 | Kemper | |
| 6,345,480 | B1 * | 2/2002 | Kemper et al. | 52/395 |
| 6,647,680 | B2 * | 11/2003 | Daly et al. | 52/287.1 |

FOREIGN PATENT DOCUMENTS

| | | | |
|---|---|---|---|
| BE | 531 202 | A | 11/1957 |
| DE | 295 21 766 | U1 | 8/1998 |
| DE | 199 26 548 | A1 | 6/2000 |
| DE | 201 17 167 | U1 | 1/2002 |
| EP | 0 816 588 | A | 1/1998 |
| EP | 0839 973 | A | 5/1998 |
| EP | 1036 896 | A | 9/2000 |
| WO | WO 00/14351 | A | 3/2000 |

* cited by examiner

*Primary Examiner*—Robert Canfield
*Assistant Examiner*—Jessie Fonseca
(74) *Attorney, Agent, or Firm*—Stroock & Stroock & Lavan, LLP

(57) ABSTRACT

The edge protector, especially for stair edges, comprises of a step profile and a base profile being fixable on a stair. The step profile has a step part and a step riser flange that is formed thereat, and the base profile comprises a base plate on which a support arrangement is formed. The step profile being non destructively unlockably fixable onto the base profile by means of a continuously height adjustable mounting, comprises fastening means, and a downwardly directed rib being formed at the base plate.

31 Claims, 5 Drawing Sheets

HEIGHT ADJUSTABLE EDGE PROTECTOR

Figure 1:
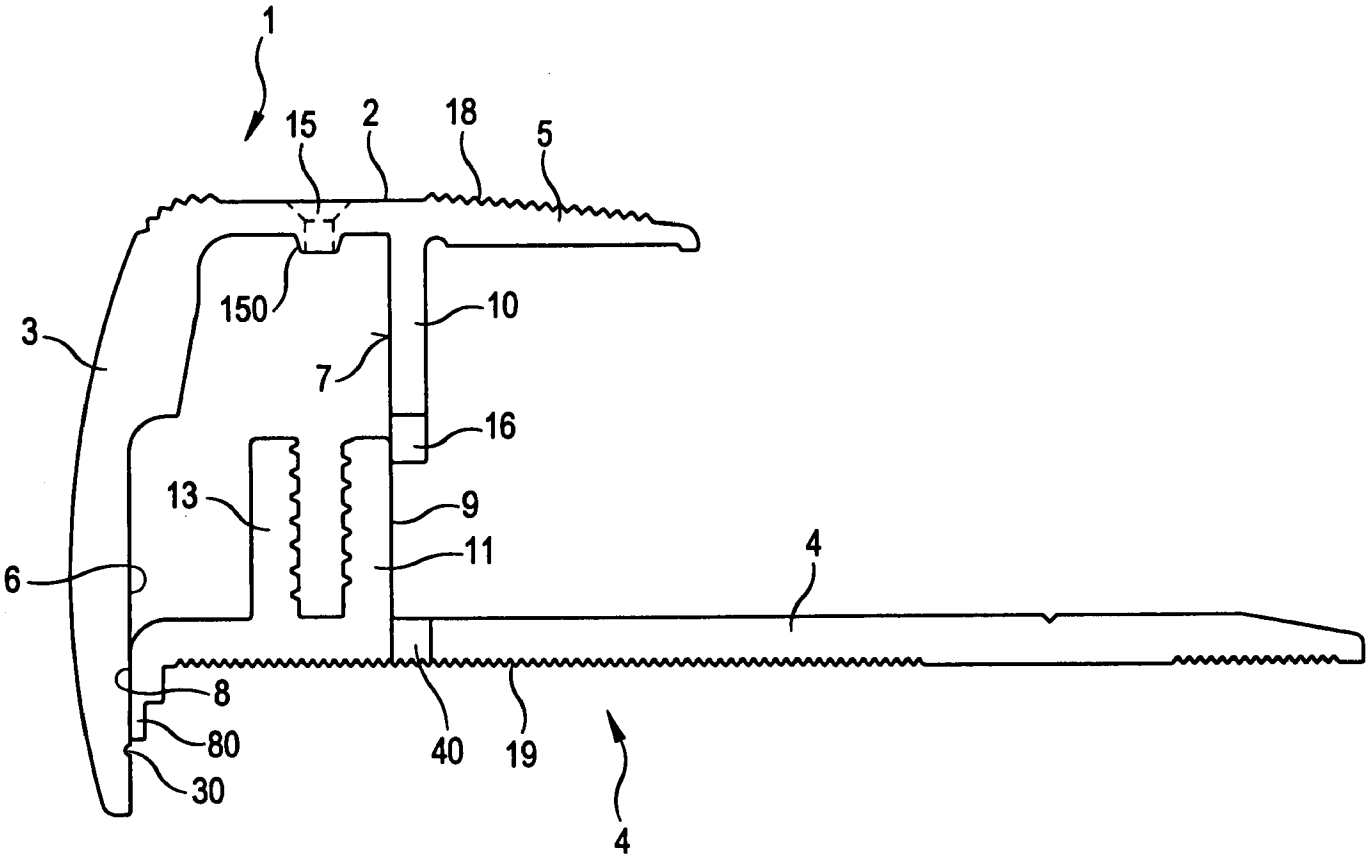

The invention relates to a protector for edges, especially for stair edges, comprising a step profile and a basis profile being capable to be fixed on a stair.

A stair tread edge protector is known from the category indicating document DE 295 21 766 U, in which the base profile at its front edge ends essentially straight and which forms at its front edge a stop for the step riser flange of the step profile. Depending on the type of embodiment the front area can be provided with a grating engaging a respective grating at the stop face of the step riser flange.

From U.S. Pat. No. 4,444,797 a stair nosing is known consisting of a base profile and a riser cover being integrally formed at the base profile. The base profile is formed in L-shape around the stair tread and is fixed at the stair by means of a nail. At the edge of the stairs tread the base profile has a slope which serves as a contact area for the step profile. The outside of the base profile and the inner side of the step profile fit together positively. The step profile is made of plastic and comprises air chambers to improve damping characteristics. At both ends of the step profile cover flaps are formed pressing the carpet against the base profile after the step profile has been put onto the base profile. The use is limited to carpets which are compressed and clamped between the cover flaps and the base profile.

A drawback of this construction is that the use is limited to flexible stair covers, i.e. carpets having a certain thickness of the material. If carpets with a varying height are laid, an adequate stair nose has to be used for every thickness of the material. When using laminate or parquet floor such a stair nose cannot be used since during mounting it is necessary to form an ondulation into the cover, so that the outer ridge can slip into the respective notch of the stair nose. Additionally the laminate step riser has to be bent away thus increasing the danger that it may get loose from the ground.

Object of the invention is to provide a stair tread edge protector of the type mentioned above so that the stair tread edge protector can be used for stair covers of different material thickness without extensive measuring and mounting efforts.

This task is solved by the inventive edge protector, which is especially designed for stair edges, comprising a step profile and a base profile being fixable on a stair, a step profile having a step part and a step riser flange flange which is formed thereat, and a base profile comprising a base plate, on which a support arrangement is formed and the step profile being non destructively unlockably fixable onto the base profile by means of a continuously height adjustable mounting, and comprising fastening means, and comprising a downwardly directed rib being formed at the base plate.

Advantageously the step profile and the base profile are unlockably mounted by means of the height adjustable mounting. When mounting edge protectors having a height adjustable step profile at stairs with parquet floor or laminate floor it was necessary to mark the position of the base profile comprising the bore holes together with the mounted step profile with a pen or by spot drilling. Then the step profile had to be able to be removed since a stiff floor covering, especially in case of spiral stair cases, could not be engineered under the cover flange. By means of the inventive embodiment the base profile can be threaded directly without auxiliary means and without marking the position of the bore holes beforehand. It is merely necessary to cut the correct length of the base profile and by simultaneously pressing the screw can be fixed.

In doing so it is advantageous that a stop face is formed on the side of the rib which faces the stair edge. An additional advantage is that a crank is provided at the free end of the rib forming a shoulder. In the gap being provided by such an embodiment a protrusion of a cover can be clamped covering either the edge of the laminate on the step riser flange/floor cover or the cut face of the edge protector.

It also is advantageous that the step profile comprises two guiding support faces extending at a distance from each other in parallel, which engage with adequately assigned counter-faces being arranged at the base profile. By the engagement of the guiding support faces with the counter-faces at the base profile the vertical movement of the step profile is ensured. Also the step moment during stepping onto the step profile is transferred onto the base profile by this skilful embodiment of the guiding support faces and the counter-faces.

In this connection it is favorable that at the step profile a rib is arranged being directed essentially towards the tread, at the side of said rib, which is directed to the stair edge, the first guiding support face is arranged, and that at an adequate position at the base profile an adequate rib is arranged comprising the counter-face which is directed towards the first guiding support face.

Furthermore it is favorable that the second guiding support face is arranged at the step riser flange and the associated counter-face is arranged at an essentially forwardly directed front edge of the base profile.

An advantageous alternative provides that the second guiding support face is arranged at the step riser flange and that the adequately assigned counter-face is arranged at a second rib, which is positioned at an adequate place on the base profile.

Regarding the adjustment of the height of the step profile it is very beneficial that the ribs at the base profile and the inner side walls of the ribs are designed in such a way that a thread drive channel is formed by them.

It is favorable that the step flange comprises counter-holes for receiving the drive screws. By means of the drive screws the distance between the step profile and the base profile are adjusted so that the cover flange abuts onto the stair cover. When screwing-in the drive screws into the thread drive channel the walls of the rib on the base profile with the guiding support faces, depending on the thickness of the walls can be pressed against the counter-face of the rib of the step profile. Thus simultaneously to the height adjustment a clamping between the step profile ribs and the base profile ribs occurs.

In an advantageous variation respective engaging faces are designed as raster surfaces.

In a further advantageous alternative embodiment the height adjustable mounting is formed as at least one tooth shaped rib with projections (left side and right side) beneath the step flange, the teeth of which can engage into adequate recesses at the inner sides of the opposite ribs. By this raster embodiment the step profile and the base profile can easily be mounted and dismounted.

In order to obtain a finer graduation of the height adjustment it is very advantageous that the left side teeth are offset to the right side teeth of at least one tooth shaped rib or the left side teeth recesses are offset to the right side recesses by a predetermined distance.

The raster ribs are advantageously resiliently designed in the junction with the step flange.

For fixing the base profile on the stair the base profile comprises bore holes.

To achieve a slip safe surface it can be advantageous that the step flange on its outer side comprises grooves running into the direction of the step profile. Also on the transition between the step flange and the step riser flange grooves can be provided.

In order to fix the base profile safely on the stair and to lay the carpet on the base profile so that it does not move it is advantageous that the horizontal section of the base profile at its upper face and at its lower face shows a raster profile.

In case that the edge profile is used for the lowest possible thickness of the material, at the inner side of the step riser flange a shoulder is formed defining the lowest position of the step profile. Such a cover thickness is advantageous in case of stair noses exposed to extremely high loading because the step profile can support itself by means of the stop face at the base profile in this stop position.

It has turned out as very advantageous that the step profile and the base profile are manufactured from aluminum. Both parts, or also only the base profile can be made from plastics or plastic laminate or plastic compound instead of aluminum. In such a situation the embodiment is advantageous in which the thread drive channel is encroached by the ribs protruding from the step profile downwardly, thus avoiding evasion of the walls of the thread channel.

Further advantageous embodiments of the invention are disclosed in the sub-claims.

Figure 2:
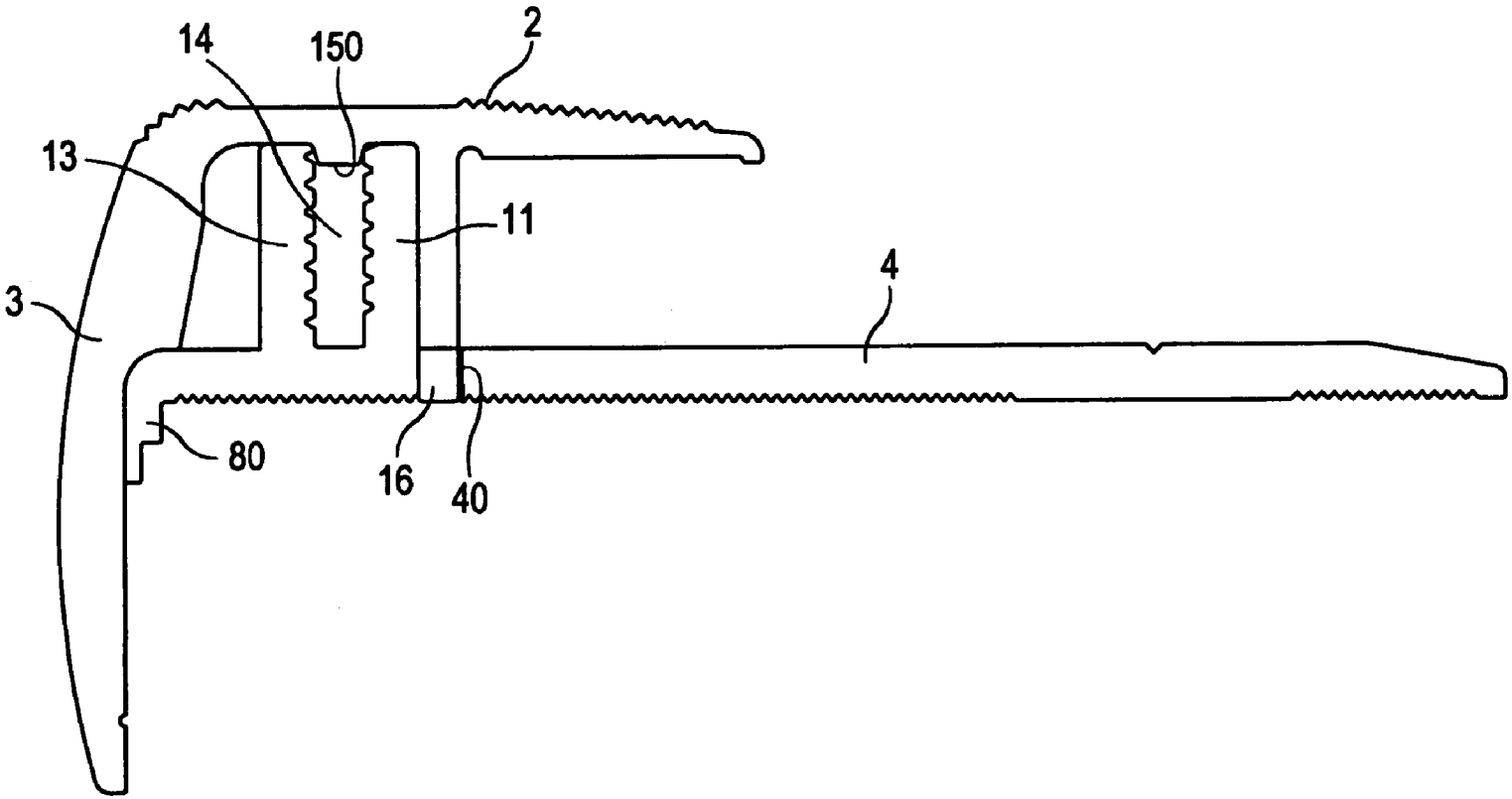
Figure 3:
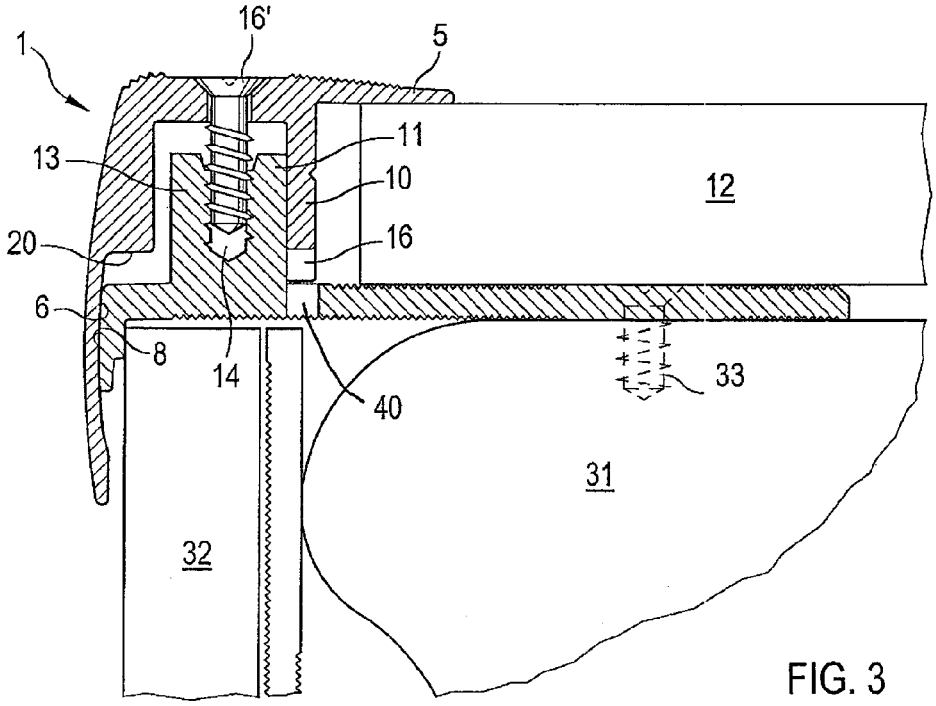
Figure 4:
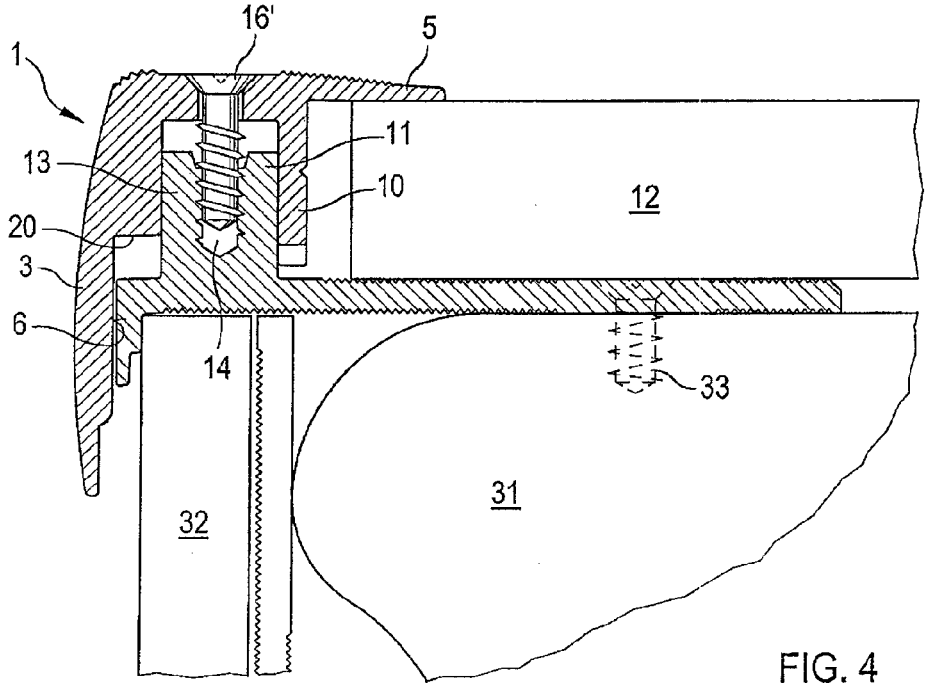
Figure 5:
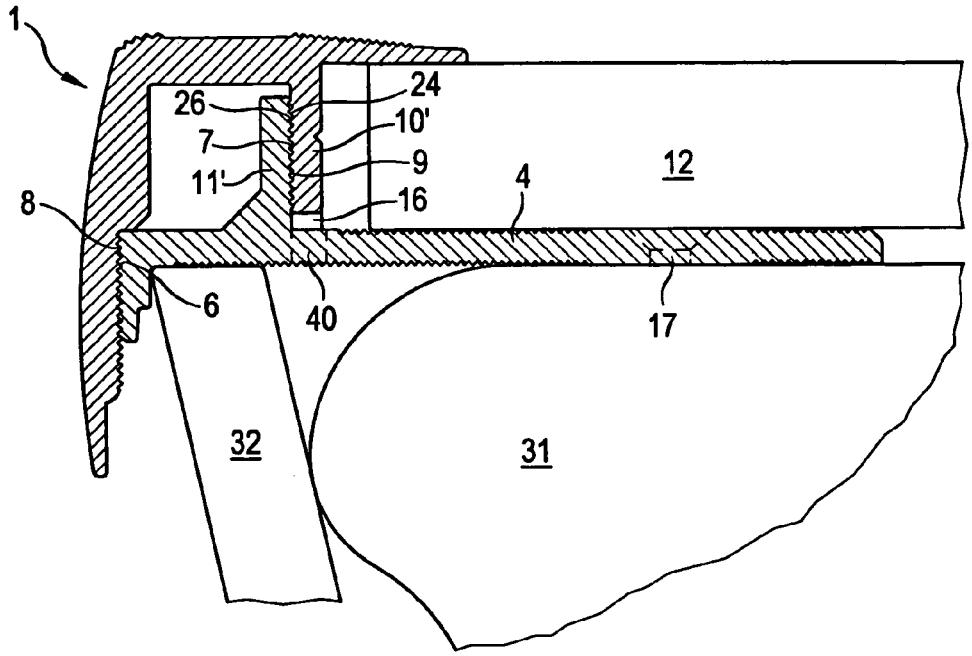
Figure 6:
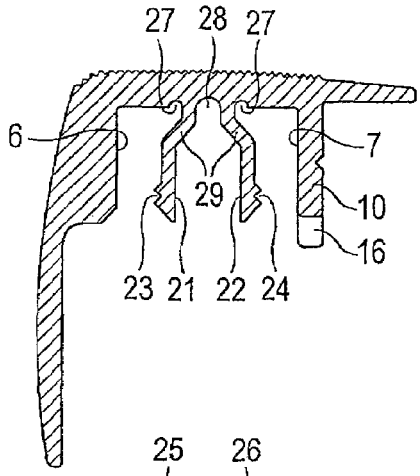
Figure 7:
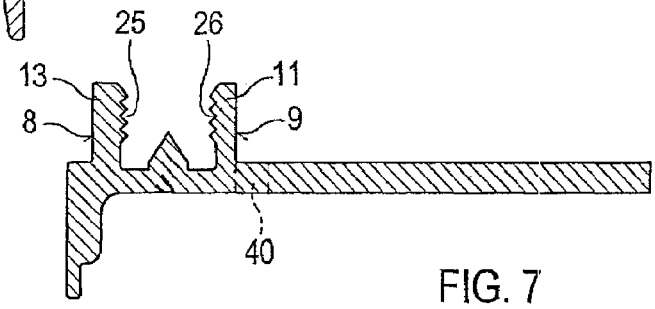
Figure 8:
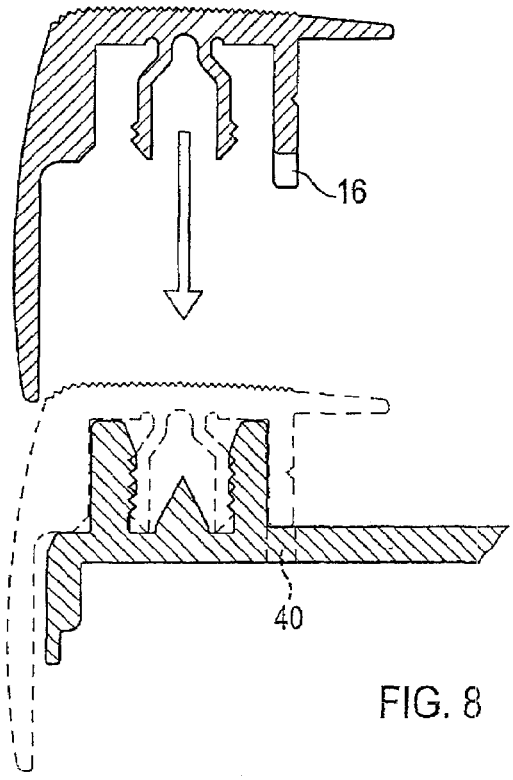

In the following the invention will be described by means of embodiments shown in the drawings in greater detail. The drawings show:

FIG. 1 a side elevation of a first embodiment of the edge protector in its highest adjustment position, FIG. 2 a side elevation of the first embodiment of the edge protector in the lowest adjustment height, FIG. 3 step profile and base profile in mounted condition when used at a vertical step riser, FIG. 4 a further embodiment in mounted condition, FIG. 5 a further embodiment of a step profile and a base profile comprising raster surfaces and with inclined step riser, FIG. 6 a cross section of a step profile comprising raster ribs, FIG. 7 a cross section of a base profile corresponding to the step profile of FIG. 6, and FIG. 8 a cross section of the edge protector according to FIG. 6 and FIG. 7.

FIG. 1 shows a side view of a step profile 1, as it is used in the inventive edge protector. The step profile consist of a step surface flange 2 and a step riser flange 3 being arranged essentially perpendicularly at the step surface flange. The step surface flange 2 has a rib 10 being arranged essentially parallel to the step user flange in a certain distance. The side of the rib 10 which faces the step riser flange functions as a first guiding support face 7. The step surface flange 2 extends beyond the rib 10 and forms in that area a cover flap 5. The cover flap 5 tapers slightly to the free edge and is rounded there. With regard to its position the cover flap 5 slightly inclined toward the stair surface. In the step surface flange 2 there are counter-bores 15 formed in the area 150 between the rib 10 and the step riser flange 3. During mounting drive screws 16 are set into the counter-bores. At the surface of the step surface flange 2 in the area of the transition between the step surface flange and the step riser flange as well as in the area above the rib 10 and the cover flap 5 grooves 18 running in the longitudinal direction of the profile are formed to have a non-slip and step-safe surface. The outer side of the step riser flange 3 is shaped as a slope which runs downwardly into a radial curvature. The inner side of the step riser flange 3 comprises in this embodiment, seen from below, a first shoulder 30 after which the inner side changes into a guiding support face 6.

At the head end of the base plate 19 of the base profile 4 a downwardly directed rib 80 is formed comprising a stop face on the side facing the stair edge. This stop face abuts against the stair edge or against the outer edge of the linings at the step riser flange during mounting and thus determines the position of the base profile.

In this embodiment the outer face of the rib serves as a abutment for the inner face of the step riser flange.

Continuing the guiding support face 6 at the inner side of the step riser flange a stop face 20 is formed which defines the minimum thickness of the parquet when the step profile is mounted onto the base profile 4.

While FIG. 1 shows the application at the greatest height, FIG. 2 shows the application with the minimum height. In this situation the special embodiment of rib 10 having the protrusions 16 becomes effective. The protrusions 16 engage into the recesses 40 in the base plate. By this the range of application increases by the thickness of the material of the base plate 19.

The base profile 4 has two ribs 11, 13, the inner side walls of which are tooth-shaped in such a way that they form a thread drive channel 14 for screwing the drive screws 16'. At the outer wall of the right rib 11 a counter-face 9 is formed, which abuts the guiding support face 7 at the inner side of the rib 10 of the step profile 1. In the base plate of the base profile are holes 17 serving to mount the base profile 4 onto the stair. The base plate 19 of the base profile 4 at both sides is provided with tooth-shaped ribs 19 to hold the base profile 4 immovable on the stair and the stair liner 12 immovable onto the base profile.

FIG. 3 shows the step profile 1 and the base profile in mounted condition. The base profile 4 is fixed at the stair step 31 by means of screws 33. In this embodiment the base profile 4 has been arranged such that at the head side of the stair step a vertically extending step riser 32 can be provided. For positioning the base profile 4 it will be slided on the stair step until the rib abuts the step riser. Thereafter the step profile 1 is fixed on the base profile 4 by means of the drive screws 16'. When screwing the drive screws 16' the rib 11 of the base profile 4 engages and clamps the rib 10 of the step profile 1. The stop face 20 in this situation has no action since the carpet layer 12 has a thickness being greater than the smallest possible thickness of material.

FIG. 4 shows a further embodiment in which the step riser flange 3 abuts in the upper area at the rib 13 of the base profile 4, and thus prevents a sliding away of the rib if this is made from softer material, i.e. plastic.

FIG. 5 shows a further embodiment. In this figure the guiding support faces 6, 7 and the respective counter-faces 8, 9 are tooth-shaped. The base profile 4 in this embodiment has only one rib 11'. In this embodiment the step profile 1 has no counter-holes 15. The step profile is fixed on the base profile only by a clip function between both parts. In this picture the rib 10' and the mounting situation at a minimum height of the stair liner 12 is shown. However, this embodiment is also useful in case of thicker floor covering 12 like parquet.

In FIG. 6 a section of an alternative step profile 1 is shown. For fixing the step profile 1 at a base profile 4 which is mounted on the stair, the step surface flange 2 has two tooth-shaped ribs 21 and 22, extending essentially perpendicularly. The tooth-shaped ribs 21 and 22 have at their outer sides protrusions 23 and 24 for adjustment at the base profile 4. The protrusions 23 and 24 in this embodiments are symmetrical, in a different embodiment, however, they also can be in offset order to each other by a certain distance. The protrusions 23 and 24 are shown as teeth, the areas of which facing outwardly are more flat than their back face with regard to the longitudinal axis of the tooth-shaped ribs 21, 22. The tooth-shaped ribs 21, 22 are resilient at their junction to the step surface flange 2. The transition of the tooth-shaped ribs 21, 22 into the step profile 1 is shaped by an outside radius 27 and an inside radius 28, respectively. The wall of the tooth-shaped ribs 21, 22 is offset in view to the junction by means of a sloped section 29 with regard to its inner side.

FIG. 7 shows a cross section of the base profile 4 corresponding to the step profile 1 of FIG. 6. The ribs 11 and 13 at their inner sides have recesses 25, 26 which are in this embodiment in offset order towards each other by half of the distance of the recesses. The ribs 11, 13 are tapered at their upper inner side by means of a chamfer. Between the ribs 11 and 13 a deflection device is provided comprising the shape of a prism raising its top upwardly.

In FIG. 8 the step profile 1 as well as the base profile 4 is shown in dismounted and in mounted state. The mounted state shows only one mounted position in which the step profile 1 is completely arranged on the base profile 4. This is the position for the minimum possible material thickness of the stair cover being in the prestressed condition.

In the mounted condition it is easy to see how both the guiding support faces 6 and 7 engage both of the ribs 11 and 13 and closely abut to the counter-faces 9 and 8 of the ribs 11 and 13. The thickness of the ribs 11 and 13 is selected in such a way that they nearly completely fill the recess between the guide faces 6 and 7 and the outsides of the tooth-shaped ribs 21 and 22. The height of the ribs 11, 13 is adjusted to the height of the tooth-shaped ribs 21, 22 as well as to the height of the rib 10 and the guiding support face 6.

In this embodiment showing the mounted condition only the left tooth-shaped rib 21 engages with its teeth 23 into the recesses of the teeth 25 of the left rib 13. The right tooth-shaped rib 22 and its teeth 24 in this embodiment is spring-loaded pushed away, since the teeth recesses of the ribs 11, 13 are in offset order regarding each other by half of the recess distance.

The embodiments shown in the FIGS. 5 to 8 also show a downwardly directed rib 10. As for the rest, all the embodiments are only examples and are not to be understood as a restriction, as also additional embodiments not yet shown are possible.

The invention claimed is:

1. An edge protector suitable for a stair edge, comprising:

a step profile and a base profile fixable on a stair;

the step profile having a step riser, a support rib having a guiding support face, and a protrusion extending past the support rib toward the base profile;

the base profile comprising a base plate, the base plate having a support arrangement and a downward rib; and a height adjustable mounting for removably coupling the step profile to the base profile, the height adjustable mounting providing continuous height adjustment of the step profile relative to the base profile, the base profile having a thickness and further comprising a counter-face constructed and arranged to engage the guiding support face and a recess constructed and arranged to receive the protrusion when the height adjustable mounting is adjusted to fully engage the base profile with the step profile, wherein the recess extends through the thickness of the base profile.

2. The edge protector according to claim 1, wherein the downward rib comprises a stop face constructed and arranged to face the stair edge.

3. The edge protector according to claim 1, wherein the downward rib has a shoulder.

4. The edge protector according to claim 1, wherein the base plate has a front end constructed and arranged to be adjacent to the stair edge and wherein the downward rib is proximate the front end of the base plate.

5. The edge protector according to claim 1, wherein the downward rib comprises a step interval.

6. The edge protector according to claim 1, wherein the step profile further comprises a step flange constructed and arranged to lay on a floor covering; and wherein the base profile comprises at least one base rib having a first counter-face constructed and arranged to face the guiding support face.

7. The edge protector according to claim 6, wherein the base profile includes a forwardly directed front edge, the step riser flange comprises a second guiding support face and the base profile comprises a second counter-face proximate the forwardly directed front edge of the base profile.

8. The edge protector according to claim 6, wherein the support rib comprises a second guiding support face.

9. The edge protector according to claim 6, wherein the step riser flange comprises a second support face and wherein the base profile comprises a second base rib comprising a second counter-face.

10. The edge protector according to claim 6, wherein the base profile includes at least two base ribs constructed and arranged to collectively define a thread drive channel for a drive screw constructed and arranged to couple the step profile to the base profile.

11. The edge protector according to claim 10, wherein the step flange comprises counter-bores for receiving the drive screws.

12. The edge protector according to claim 11, wherein the base profile includes two step ribs and the step profile further includes a bracing rib proximate the counter-bores, the bracing rib constructed and arranged to be able to enter between said step ribs.

13. The edge protector according to claim 1, wherein the step profile includes a step flange and wherein the height adjustable mounting includes at least one toothed rib with a plurality of protrusions beneath the step flange, wherein the protrusions are constructed and arranged to engage a plurality of receiving recesses of at least one receiving rib.

14. The edge protector according to claim 13, wherein the protrusions of a first toothed rib substantially mirror the protrusions of a second toothed rib; or the receiving recesses of a first receiving rib substantially mirror the receiving recesses of a second receiving rib, wherein the receiving ribs are separated by a predetermined distance.

15. The edge protector according to claim 13, wherein the at least one toothed rib is constructed and arranged to be resilient at its junction with the step flange.

16. The edge protector according to claim 13, wherein the protrusions are designed as teeth having peaks and valleys wherein the peaks are flatter than the valleys.

17. The edge protector according to claim 13, wherein the receiving recesses are formed by peaks and valleys wherein the peaks are flatter than the valleys.

18. The edge protector according to claim 15, wherein the step profile comprises an outer notch and an inner notch proximate a junction of the at least one toothed rib and the step flange.

19. The edge protector according to claim 13, wherein the at least one tooth-shaped rib comprises a sloped junction wall proximate the step flange.

20. The edge protector according to claim 1, wherein the base profile comprises one or more bores for fixing the edge protector onto the stair.

21. The edge protector according to claim 1, wherein the step flange comprises an outer side, the outer side of the step flange comprising grooves.

22. The edge protector according to claim 1, wherein the step profile comprises a step flange, wherein the transition between the step flange and the step riser flange comprises grooves for providing an anti-slip surface.

23. The edge protector according to claim 1, wherein the base profile includes a horizontal portion, the horizontal portion of the base profile having a grooved surface.

24. The edge protector according to claim 1, wherein the step riser flange includes an inner side and a shoulder located at the inner side of the step riser flange.

25. The edge protector according to claim 1, wherein the step riser flange includes an outer side, the outer side of the step riser flange being curved.

26. The edge protector according to claim 1, wherein the downward rib is beveled.

27. The edge protector according to claim 1, wherein the step profile and the base profile comprise aluminum.

28. The edge protector according to claim 1, wherein the step profile and/or the base profile comprise at least one of a plastic, a plastic laminate and/or a plastic compound material.

29. The edge protector according to claim 1, wherein the step profile comprises a step flange, the edge protector further comprising a cover flange or top of the step flange having grooves for providing an anti-slip surface.

30. An edge protector suitable for a stair edge, comprising:

a step profile and a base profile fixable on a stair;

the step profile having a step riser, a support rib having a guiding support face, and a protrusion extending past the support rib toward the base profile;

the base profile comprising a base plate, the base plate having a support arrangement and a downward rib; and a height adjustable mounting for removably coupling the step profile to the base profile, the height adjustable mounting providing continuous height adjustment of the step profile relative to the base profile, the base profile having a thickness and further comprising a counter-face constructed and arranged to engage the guiding support face and a recess constructed and arranged to receive the protrusion at varying depths when the height adjustable mounting adjusts the height of the step profile relative to the base profile, wherein the recess extends through the thickness of the base profile.

31. An edge protector suitable for a stair edge, comprising:

a step profile and a base profile fixable on a stair;

the step profile having a step riser flange having a support surface, the step profile further having a support rib having a guiding support face, and a protrusion extending past the support rib toward the base profile;

the base profile comprising a base plate, the base plate having a support arrangement and a downward rib, the downward rib having a counter-support surface constructed and arranged to contact the support surface of the step riser flange; and a height adjustable mounting for removably coupling the step profile to the base profile, the height adjustable mounting providing continuous height adjustment of the step profile relative to the base profile, the base profile having a thickness and further comprising a counter-face constructed and arranged to engage the guiding support face and a recess constructed and arranged to receive the protrusion when the height adjustable mounting is adjusted to fully engage the base profile with the step profile, wherein the recess extends through the thickness of the base profile.

* * * * *